US005179327A

United States Patent [19]

Yagi et al.

[11] Patent Number: 5,179,327

[45] Date of Patent: Jan. 12, 1993

[54] HIGH TENSION CABLE DEVICE

[75] Inventors: Kiyoshi Yagi; Seiichi Wakabayashi; Hiroshi Suzuki, all of Shizuoka; Kazuhisa Mogi, Aichi, all of Japan

[73] Assignees: Yazaki Corporation, Tokyo; Toyota Jidosha Kabushiki Kaisha, Aichi, both of Japan

[21] Appl. No.: 798,249

[22] Filed: Nov. 26, 1991

[30] Foreign Application Priority Data

Nov. 29, 1990 [JP] Japan ..... 2-325388

[51] Int. Cl.[5] ..... F02P 3/02

[52] U.S. Cl. ..... 315/77; 315/326; 315/181; 123/627; 123/169 P; 439/125

[58] Field of Search ..... 315/77, 179, 180, 181, 315/182, 183, 211, 243, 290, 322, 326; 123/594, 627, 169 R, 169 P, 169 PA, 169 PB, 169 PH, 169 MG; 439/125, 126, 127, 128

[56] References Cited

U.S. PATENT DOCUMENTS

| | | | |
|---|---|---|---|
| 4,549,114 | 10/1985 | Herden | 315/58 |
| 4,671,586 | 6/1987 | DeBolt | 439/126 |
| 4,751,430 | 6/1988 | Muller et al. | 315/57 |
| 4,770,152 | 9/1988 | Mogi et al. | 123/621 |
| 5,080,083 | 1/1992 | Sato et al. | 123/627 |

FOREIGN PATENT DOCUMENTS

| | | |
|---|---|---|
| 63-75568 | 5/1988 | Japan . |
| 63-101486 | 7/1988 | Japan . |
| 1-85469 | 6/1989 | Japan . |
| 2-22667 | 2/1990 | Japan . |
| 2-43474 | 3/1990 | Japan . |

*Primary Examiner*—David Mis

*Attorney, Agent, or Firm*—Armstrong, Westerman, Hattori, McLeland & Naughton

[57] ABSTRACT

A high tension cable device according to the present invention for use with an ignition system having a discharge tube for forming a series gap therein in an automobile engine or the like can eliminate a so-called creeping discharge which is likely to occur along the external peripheral surface of the discharge tube, and the above cable device comprises; a cylindrical casing having a connecting terminal therein in a firmly engaged formed at one end thereof, which connecting terminal being engageable with a terminal of an ignition plug of an engine side; an auxiliary functional section composed of one or a plurality of auxiliary functional parts such as the discharge tube which are fixedly inserted into said cylindrical casing, wherein the front end of the auxiliary section is connected to the rear end of the connecting terminal, and the rear end thereof is connected to a terminal of a high tension cable side, characterized in that the cylindrical casing is formed by an electrically insulating rigid material and the outer periphery of the auxiliary section is covered with an electrically insulating elastic layer, which cylindrical casing and elastic layer forming a space between respective inner and outer surfaces. The high tension cable device constructed above never causes unmeasurable destruction of insulation, so that a cable device of a high reliability is made possible.

10 Claims, 6 Drawing Sheets

HIGH TENSION CABLE DEVICE

BACKGROUND OF THE INVENTION

1. Field of the Invention

This invention relates to a high tension cable device for use with an ignition system in an automobile engine or the like.

2. Description of the Prior Art

An ignition system in an automobile or the like is normally constructed in such a manner as to generate sparks by applying a high voltage to an ignition plug, and heretofore, there has been known an ignition system having a so-called series gap which is provided in series with a spark plug to avoid the problems of plug fouling.

An ignition system having the series gap constructed as above is disclosed, for example, in a Utility Model Application Laid-Open No. 61-101486. This ignition system is constructed as shown in FIG. 5, wherein reference character A denotes an ignition plug which is threadedly engaged with a cylinder head B of an engine, and on the other hand, a high tension cable C is fitted removably on the ignition plug A, which high tension cable C further comprising a plug cap 6 in which a connecting terminal 2 engageable with a terminal 1 of the ignition plug A and a cable terminal 4 connected to one end of a high tension cable 3 are located such that they are facing to each other with a space therebetween, for example, in a cylindrical casing 5. Further, between the connecting terminal 2 and the cable terminal 4 within the plug cap 6, a discharge tube 10 forming a series gap S by sealing a pair of discharge electrodes 7 and 8 into a glass tube 9 is disposed.

An ignition system having a series gap as constructed above requires a discharge tube having a high discharge starting voltage (a high breakdown voltage) for correctly sparking the spark plug even if the plug is fouled, but when a high voltage is supplied, a so-called creeping discharge is likely to occur along the external surface of the discharge tube before starting the discharge at the series gap. In order to prevent the occurrence of this creeping discharge, although another method such as filling an electrically insulating resin in the space between the discharge tube and the casing can be taken, since the ignition system is likely to receive abrupt heating and cooling phenomenon repetitively in accordance with driving operation of the engine, the casing and other devices are likely to be worn out, and in addition, tiny cracks can be generated in the parts where thermal stress is applied, and furthermore, since a grounding instrument is normally disposed in the nearby region of the ignition system, destruction of the insulation or the like may be caused thereby and an ignition failure of the engine can also take place due to the energy loss caused thereby.

SUMMARY OF THE INVENTION

The present invention has been made to eliminate such problems as described above, and it is an object of the present invention to provide a highly reliable high tension cable device having a series gap which never causes an unmeasurable destruction of insulation or the like.

In order to attain the above object, the present invention provides a high tension cable device which comprises: a cylindrical casing having a connecting terminal therein in a firmly engaged form at one end thereof, the connecting terminal being engageable with a terminal of an spark plug of an engine side; and an auxiliary functional section composed of one or a plurality of functional parts, each of which is connected in series and fixedly inserted into the cylindrical casing, wherein the front end of the auxiliary functional section is connected to the rear end of the connecting terminal, and the rear end thereof is connected to a terminal of a high tension cable side, and is characterized in that the cylindrical casing is formed by an electrically insulating rigid material, the outer periphery of the auxiliary functional section is covered with an electrically insulating elastic layer, and that the cylindrical casing and the elastic layer are forming a space between respective inner and outer surfaces.

In the above construction, the auxiliary functional section may be composed of only one functional part which is a discharge tube for forming a series gap having discharge electrode terminals at the respective front and rear ends thereof, which front end being connected to the connecting terminal and rear end being connected to a cable terminal which is further connected to the high tension cable, or may be composed of a plurality of functional parts which are the above described discharge tube; an intermediate connecting terminal whose front end is connected to the rear electrode terminal; and a resisting element whose front end is connected to the rear end of the intermediate connecting terminal; wherein the rear end of the resisting element is connected to a cable terminal whose rear end is connected to the high tension cable. In addition, the high tension cable device as constructed above further comprises a positioning means for maintaining the cylindrical casing and the auxiliary functional section on the same axis.

In the high tension cable device according to the present invention, the electrically insulating rigid material forming the cylindrical casing can be made by a material selected from a group of engineering resin materials; unsaturated polyester resin, aromatic polyester resin, and polyphenylene sulfide, but as long as the electrically insulating material to be adopted contains a protecting function against external forces, the material is not limited to a specific one. Further, the electrically insulating elastic layer is made preferably of a silicon rubber or the like, but the material is not either limited to a specific one as long as it contains absorbing function of the stress caused when the auxiliary functional section is expanded and/or shrunk.

By the way, as a positioning method for maintaining the auxiliary functional section such as a discharge tube at the same axis of the cylindrical casing, for example, a clamp made of an electrically insulating resin, a spacer formed in the periphery of the auxiliary functional section and so on can be adopted.

Further, in the present invention, the space formed between the external surface of the elastic layer coating the periphery of the auxiliary functional section and the inner side surface of the cylindrical casing should be maintained even when a deformation of the adopted materials is caused by thermal expansion. Therefore, dimension of these materials to be adopted should be decided in such a manner that the elastic layer and the cylindrical casing should not contact to each other even when temperature rises, by taking coefficient of thermal expansion of the selected elastic material and that of the rigid material selected for the cylindrical casing into consideration, and also by taking expansion and shrinkage of the selected materials during the molding operation thereof, thickness of the elastic layer and so on into consideration.

In fact, in the high tension cable device according to the present invention, the auxiliary functional section such as a discharge tube in which a high electric voltage supplied from one end of the high tension cable flows are all covered by electrically insulating elastic layer, whereby inner stress caused within these auxiliary functional section is absorbed by the elastic layer, and external forces such as bending, torsional and pulling stresses are cut off by the cylindrical casing, so that the auxiliary functional section and the respective connecting portions thereof stored inside do not receive any unbearable stress, and deterioration of the electrical and insulating efficiency thereof can be thereby prevented.

In addition to this, since the auxiliary functional section is maintained in the same axis as the cylindrical casing, electric fields are rarely biased, so that a high tension cable of a high safety level can be thereby obtained.

BRIEF DESCRIPTION OF THE DRAWINGS

The above and other objects, features and advantages of the present invention will become apparent from the following description taken in conjunction with the accompanying drawings, in which:

FIGS. 1A and 1B to 4 are sectional views respectively illustrating embodiments of the high tension cable device according to the present invention.

Figure 1A:
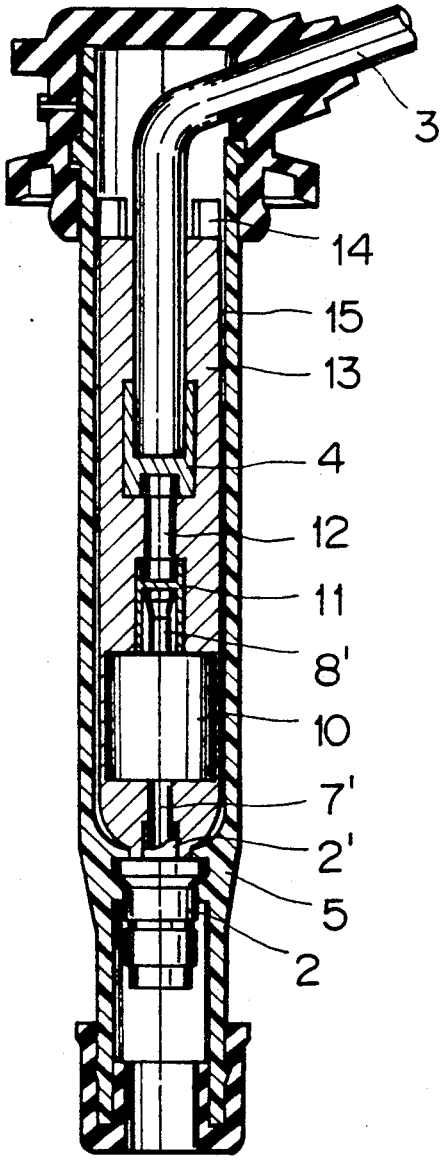

In the figures, reference character A denotes an ignition plug, reference character B denotes a cylinder head, character C denotes a high tension cable device, S denotes a series gap, reference numeral 1 denotes a plug terminal, reference numeral 2 denotes a connecting terminal, numeral 2' denots a female terminal, 3 a high tension cable, 4 a cable terminal, 5 a casing, 6 a plug cap, 7 and 8 each denotes a discharge electrode, 7' and 8' each denotes a discharge electrode terminal, 9 denotes a glass tube, 10 denotes a discharge tube, 11 an intermediate connecting terminal, 12 a resisting element, 13 an elastic coating layer, 14 a positioning clamp, 15 a space, and reference numeral 16 denotes a head cap.

DETAILED DESCRIPTION OF THE PREFERRED EMBODIMENTS

In the following, various embodiments of a high tension cable device according to the present invention are described with reference to the drawings. By the way, it is to be noted that like reference characters in each figure denote like or corresponding portions of the conventional embodiments so as to avoid repetition of the explanation.

FIG. 1A shows one embodiment of the high tension cable device according to the present invention, which is constructed such that it comprises a connecting terminal 2 to be connected with an ignition plug disposed at one end of a cylindrical casing 5 which is formed either by unsaturated polyester resin or by saturated polyester resin such as PBT, and is connected to a high tension cable 3, wherein the connecting terminal 2 is formed with a female terminal 2' at the rear end thereof for engaging a discharge electrode terminal 7' of the discharge tube 10 therewith, and a resisting element 12 is connected to the other discharge electrode terminal 8' of the discharge tube 10 through an intermediate connecting terminal 11 whose both terminal ends are of female type, and further, to the rear end of this resisting element 12, a cable terminal 4 connected to one end of the high tension cable 3 is engageably connected.

Furthermore, these connecting terminal 2, discharge tube 10, intermediate connecting terminal 11 and the resisting element 12 are all covered by a coating layer 13 made by molding adhesive silicon rubber, and thereby electrically conductive portions are all insulated.

In addition, in order to maintain the axis of a terminal 4 of the high tension cable at the position of that of the casing 5, a positioning clamp 14 is installed, and an air space 15 is formed between the external surface of coating layer 13 and the inner surface of the casing 5.

Figure 1B:
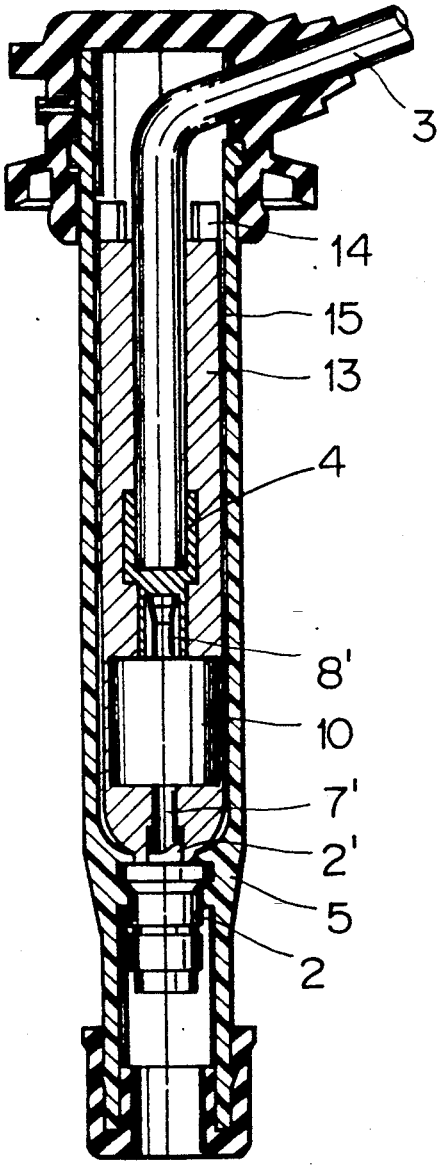

FIG. 1B shows a modification of the embodiment shown in FIG. 1A, wherein an auxiliary functional section is composed of only the discharge tube for forming a series gap having discharge electrode terminals at the respective front and rear ends thereof, which rear end being connected to a cable terminal whose rear end is further connected to the high tension cable.

Figure 2:
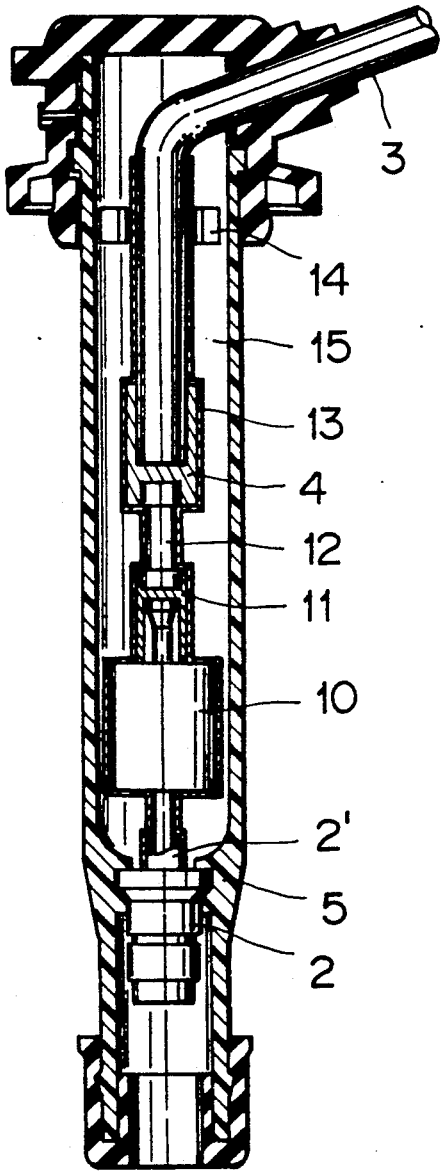

FIG. 2 shows another embodiment of the high tension cable device according to the present invention, wherein the elastic coating layer 13 is coated by molding a dip coat of the silicon rubber on the surface of the auxiliary functional section.

For this reason, the air space 15 in this embodiment is made wider than the first embodiment, but otherwise the construction thereof is almost same as that of the first embodiment.

Figure 3:
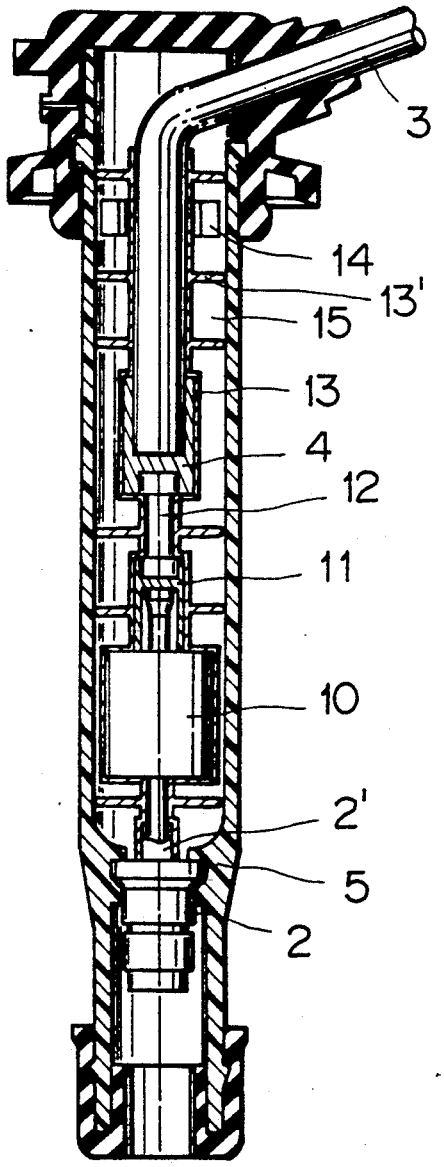

FIG. 3 shows further embodiment of the high tension cable device according to the present invention, wherein the elastic coating layer 13 is made by covering the auxiliary functional section with a shrinkable tube having pucker portions which is made of silicon resin, and positioning of the auxiliary functional section is performed by the positioning clamp 14 and the pucker portions 13' formed on the elastic coating layer 13.

Figure 4:
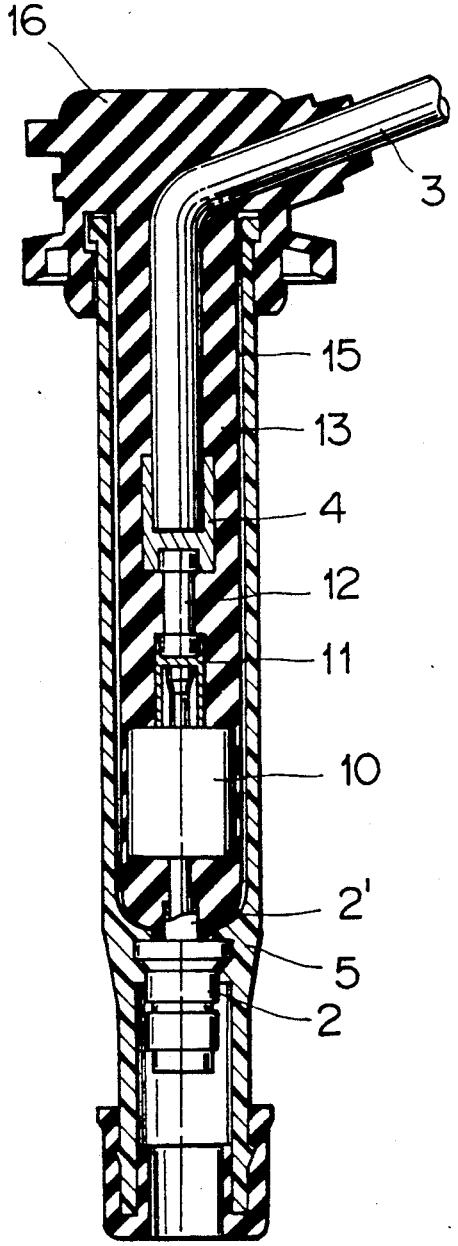
Figure 5:
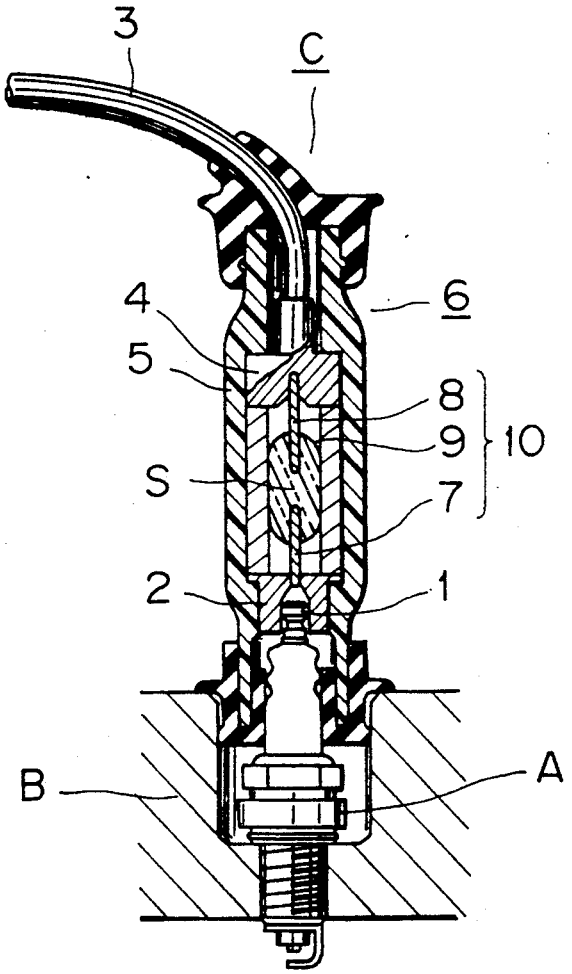
FIG. 5 PRIOR ART
FIG. 5 is a sectional view showing a conventional high tension cable.

FIG. 4 shows still another embodiment of the high tension cable device according to the present invention, wherein a head cap 16 is also incorporated by molding liquid silicon rubber when forming the elastic coating layer 13 in the same manner as the first embodiment, and after that the casing 5 is engageably installed thereon, so that a positioning clamp 14 is not adopted in this embodiment.

EFFECT OF THE INVENTION

A high tension cable device according to the present invention is characterized in that a creeping discharge is not generated along the auxiliary functional section installed therein, specially not around the outer periphery of the discharge tube, and in addition, there is no fear of deterioration of the function thereof which may be caused due to the repetitive abrupt heating impact and/or external forces, so that the reliability of the device as a whole becomes substantially of high level.

While the invention has been described with reference to specific embodiment, the description is illustrative and is not to be construed as limiting the scope of the invention. Various modifications and changes may occur to those skilled in the art without departing from the script and scope of the invention as defined by the appended claims.

What is claimed is;

1. A high tension cable device comprising:

a cylindrical casing having a connecting terminal therein in a firmly engaged form at one end thereof, said connecting terminal being engageable with a terminal of an ignition plug of an engine side;

an auxiliary functional means composed of one or a plurality of functional parts each of which is connected in series and fixedly inserted into said cylindrical casing, wherein the front end of said auxiliary functional means is connected to the rear end of said connecting terminal, and the rear end thereof is connected to a terminal of a high tension cable side, characterized in that said cylindrical casing is formed by an electrically insulating rigid material and the outer periphery of said auxiliary functional means is covered with an electrically insulating elastic layer, said cylindrical casing and said elastic layer forming a space between respective inner and outer surfaces.

2. A high tension cable device as defined in claim 1, wherein said auxiliary functional means is composed of only a discharge tube for forming a series gap having discharge electrode terminals at the respective front and rear ends thereof, said front electrode terminal being connected to the rear end of said connecting terminal, and said rear electrode terminal being connected to a cable terminal which is further connected to said high tension cable.

3. A high tension cable device as defined in claim 1, wherein said auxiliary functional means is composed of a plurality of functional parts such as;

a discharge tube for forming a series gap having discharge electrode terminals at the respective front and rear ends thereof, said front electrode terminal being connected to the rear end of said connecting terminal;

an intermediate connecting terminal which is connected to said rear electrode terminal; and, a resisting elemment which is connected to the rear end of said intermediate connecting terminal; wherein the rear end of said resisting element is connected to a cable terminal whose rear end is further connected to said high tension cable.

4. A high tension cable device as defined in claim 1, wherein said device further comprising a positioning means for maintaining said cylindrical casing and said auxiliary functional means on the same axis.

5. A high tension cable device as defined in claim 1, wherein said elastic layer covering said auxiliary functional means is formed by molding adhesive silicon rubber on the peripheral surface of said auxiliary functional means.

6. A high tension cable device as defined in claim 1, wherein said elastic layer covering said auxiliary functional means is formed by molding a dip coat of silicon rubber on the peripheral surface of said auxiliary functional means.

7. A high tension cable device as defined in claim 1, wherein said elastic layer covering said auxiliary functional means is formed by covering the peripheral surface of said auxiliary functional means with a shrinkable tube having a plurality of pucker portions made of silicon resin.

8. A high tension cable device as defined in claim 1, wherein said elastic layer covering said auxiliary functional means is incorporated with a head cap of said high tension cable device by molding liquid silicon rubber on said elastic layer and said head cap simultaneously.

9. A high tension cable device as defined in claim 1, wherein said electrically insulating rigid material forming said cylindrical casing is made by a material selected from a group of engineering resin materials; unsaturated polyester resin, aromatic polyester resin, and polyphenylene sulfide.

10. A high tension cable device comprising:

a cylindrical casing having a connecting terminal therein in a firmly engaged form at one end thereof, said connecting terminal being engageable with a terminal of an ignition plug of an engine side;

an auxiliary functional means, each component of which is connected in series and fixedly inserted into said cylindrical casing, wherein the front end of said auxiliary functional means is connected to the rear end of said connecting terminal, and the rear end thereof is connected to a terminal of a high tension cable side, said cylindrical casing being formed by an electrically insulating rigid material, the outer periphery of said auxiliary functional means being covered with an electrically insulating elastic layer, and said cylindrical casing and said elastic layer forming a space between respective inner and outer surfaces, characterized in that said auxiliary functional means is composed of; a discharge tube for forming a series gap having discharge electrode terminals at the respective front and rear ends thereof, wherein said front electrode terminal is connected to the rear end of said connecting terminal; an intermediate connecting terminal whose front end is connected to said rear electrode terminal: a resisting element whose front end is connected to the rear end of said intermediate connecting terminal; and a cable terminal whose front end is connected to the rear end of said resisting element, and the rear end thereof is connected to said high tension cable, and further characterized in that said device further comprising a positioning means for maintaining said cylindrical casing and said auxiliary functional means on the same axis.

* * * * *